US011123251B2

(12) United States Patent
Carr

(10) Patent No.: US 11,123,251 B2
(45) Date of Patent: Sep. 21, 2021

(54) ABDOMINAL AND LEG MASSAGE DEVICE AND METHOD OF USE

(71) Applicant: Daniel Edward Carr, Los Angeles, CA (US)

(72) Inventor: Daniel Edward Carr, Los Angeles, CA (US)

( * ) Notice: Subject to any disclaimer, the term of this patent is extended or adjusted under 35 U.S.C. 154(b) by 11 days.

(21) Appl. No.: 16/778,788

(22) Filed: Jan. 31, 2020

(65) Prior Publication Data

US 2021/0236371 A1 Aug. 5, 2021

(51) Int. Cl.
*A61H 1/00* (2006.01)

(52) U.S. Cl.
CPC ..... *A61H 1/008* (2013.01); *A61H 2205/081* (2013.01)

(58) Field of Classification Search
CPC ..... A61H 1/008; A61H 7/003; A61H 2201/1623; A61H 2205/081; A61B 18/203
USPC ..... D24/211, 214, 215
See application file for complete search history.

(56) References Cited

U.S. PATENT DOCUMENTS

| | | | | | |
|---|---|---|---|---|---|
| 4,777,940 | A * | 10/1988 | Yamasaki | A61H 7/004 601/87 |
| D387,871 | S * | 12/1997 | Childs | D24/211 |
| 6,071,253 | A * | 6/2000 | Rivera | A61H 1/0292 601/118 |
| 6,866,644 | B1 * | 3/2005 | Kost | A61H 23/02 601/49 |
| D821,599 | S * | 6/2018 | Greenhouse | D24/212 |
| D845,500 | S * | 4/2019 | Wersland | D24/211 |
| 2010/0191161 | A1 * | 7/2010 | Mouatt | A63B 21/0552 601/137 |
| 2012/0179201 | A1 * | 7/2012 | Segur | A61H 1/008 606/237 |
| 2017/0202723 | A1 * | 7/2017 | Serola | A47C 20/027 |
| 2017/0304144 | A1 * | 10/2017 | Tucker | A61H 23/00 |
| 2017/0348175 | A1 * | 12/2017 | Emmel | A61H 7/007 |
| 2018/0311102 | A1 * | 11/2018 | Frankson | A63B 21/00185 |

* cited by examiner

*Primary Examiner* — Samchuan C Yao
*Assistant Examiner* — Nathan M Le
(74) *Attorney, Agent, or Firm* — Cohen IP Law Group, P.C.; Michael N. Cohen

(57) ABSTRACT

A massage tool that provides direct therapeutic pressure to the ventral rami and femoral nerves, and/or the psoas and iliacus muscles is disclosed. The tool includes upward pointing blades that may be properly aligned with the nerves and/or muscles to gently lengthen the nerves and relax the muscles. This in turn may lessen pressure to associated joints and bones thereby providing relief to chronic back and/or leg pain.

16 Claims, 13 Drawing Sheets

ABDOMINAL AND LEG MASSAGE DEVICE AND METHOD OF USE

COPYRIGHT STATEMENT

This patent document contains material subject to copyright protection. The copyright owner has no objection to the reproduction of this patent document or any related materials in the files of the United States Patent and Trademark Office, but otherwise reserves all copyrights whatsoever.

FIELD OF THE INVENTION

This invention relates to massage tools, including a manual massage tool with blades.

BACKGROUND

Lower back pain is a chronic condition that afflicts millions of people throughout the world. In many cases, the lower back pain is caused by an injury to anatomical structures, i.e. nerves and muscles, associated with the lumbar vertebrae (e.g., L1, L2, L3, L4, L5) of the spine, causing the vertebrae to become compressed and misaligned, discs to bulge, and/or subsequent impingement on adjacent spinal nerves, i.e. sciatica. These spinal nerve impingements can cause nerve radiation and muscle spasming in the low back, hips, and legs and subsequent chronic pain of the low back, hips, knees, and ankles.

These types of injuries can be greatly exasperated by an accompanying contraction and spasm of the ventral rami of the lumbar plexus L1-L4, femoral nerve and/or the lateral femoral cutaneous nerve, which in turn involuntarily contracts the psoas and/or iliacus muscles into spasm. The resulting spasming and/or permanent contractions of these muscles further compresses the distance between the lumbar vertebrae, causing increased misalignment and bulging of the discs and/or nerve radiation. Scar tissue adhesions forming on the psoas and/or iliacus muscles can directly adhere to the ventral rami of the lumbar plexus L1-L4, the femoral nerve and/or the lateral femoral cutaneous nerve and thereby solidify the anatomical structure of these contractions of the ventral rami of the lumbar plexus L1-L4, the femoral nerve and/or lateral femoral cutaneous nerve into a permanent ongoing spasm, which in turn results in chronic back pain, hip pain, and/or knee pain for the sufferer.

The common procedure that attempts to remedy the misaligned and/or bulging vertebrae, compressed hips, and/or knee compression can involve invasive back surgery, hip surgery, and/or knee surgery that is known to often cause further health and chronic pain issues.

In addition, massage therapy and/or physical therapy are relatively ineffective in treating disorders of the psoas, iliacus, ventral rami of the lumbar plexus L1-L4, femoral nerves, and/or lateral femoral cutaneous nerves due to the inaccessibility of these anatomical structures. Most practitioners lack the skill and/or the strength to penetrate through the abdominal wall to properly manipulate these structures. Chiropractic adjustments without skillful massage manipulation are ineffective as well, typically causing further spasming in muscles resistant to the motion of the adjustment.

However, by directly manipulating spasming ventral rami of the lumbar plexus L1-L4, femoral nerves and/or lateral femoral cutaneous nerves, as well as scar tissue adhesion laden psoas and/or iliacus muscles, the nerves may be re-lengthened, the muscles may be relaxed out of spasm, and the scar tissue adhesions can be repaired. Subsequently, muscular compression will be released from upon the lumbar vertebrae, thereby relieving the pressure on bulging discs and their impingement on adjacent spinal nerves.

Accordingly, there is a need for a massage tool that provides relief to misaligned vertebrae, bulging discs, and/or impinged nerves by applying cross-fiber pressure to the ventral rami of the lumbar plexus L1-L4, femoral nerves and the psoas muscles, as well as deep tissue pressure to the lateral femoral cutaneous nerves and iliacus muscles.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EXEMPLARY EMBODIMENTS

Figure 1:
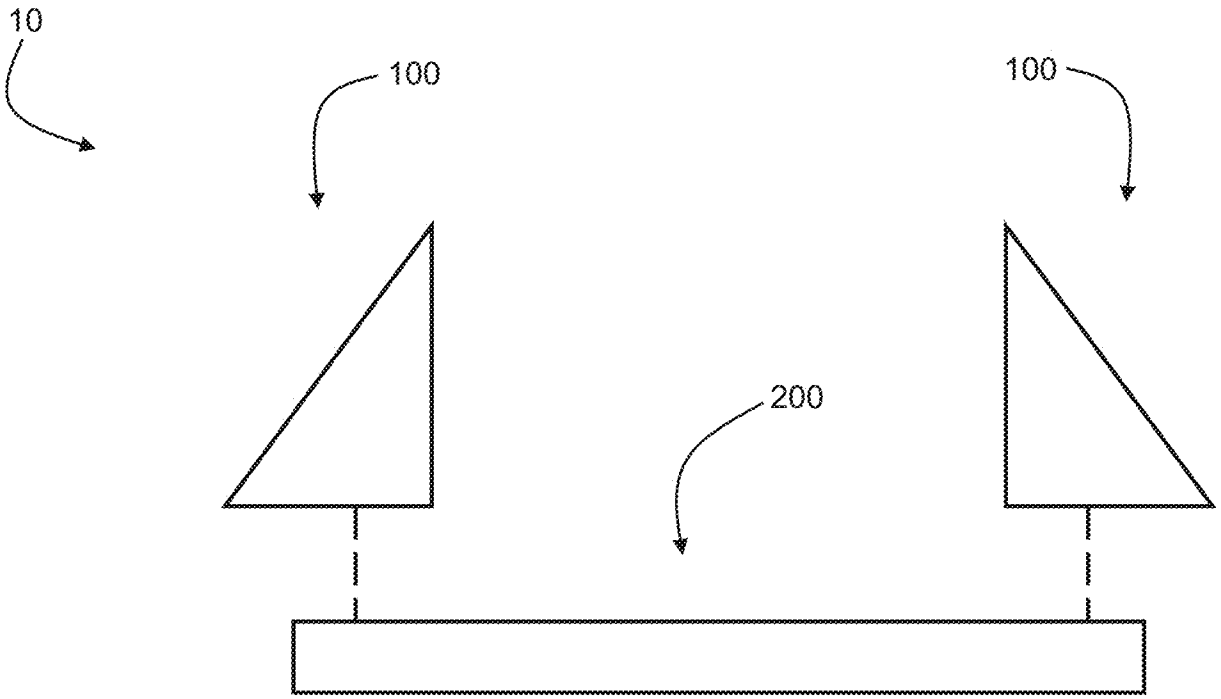
FIGS. 1 and 2 show aspects of a massage device according to exemplary embodiments hereof.

In general, the device and method according to exemplary embodiments hereof includes a massage tool for the manipulation of bodily tissues and nerves for therapeutic and/or relaxation purposes, and the tool's method of use thereof.

In some embodiments, the device includes a massage tool with one or more massage blades or wedges. In some embodiments, the blades are shaped and specifically contoured to massage and eradicate scar tissue that may have accumulated on, around, and/or in between a patient's iliacus, psoas major, and/or psoas minor muscles, and/or on the ventral rami of the lumbar plexus L1-L4, the femoral nerve, the lateral femoral cutaneous nerve and/or their branches including the saphenous nerve.

In some embodiments, the tool includes two blades (e.g., a left blade and a right blade) for treating the patient's left and right psoas muscles, ventral rami of the lumbar plexus L1-L4, femoral nerves, lateral femoral cutaneous nerves, saphenous nerves, and/or iliacus muscles. In some embodiments, the tool may include a linkage between the left and right blades.

Further details of the device, as well as the device's methods of use will be described in detail below.

The following detailed description is not intended to limit the current invention. Alternate embodiments and variations of the subject matter described herein will be apparent to those skilled in the art.

Referring now to FIGS. 1-14, the device 10 according to exemplary embodiments hereof will be described in further detail. Where the same or similar components appear in more than one figure, they are identified by the same or similar reference numerals.

In one exemplary embodiment as shown in FIG. 1, the device 10 may include a blade assembly 100 and a linkage assembly 200. In general, the linkage assembly 200 may link two or more elements of the blade assembly 100. The connection(s) between the elements of the blade assembly 100 and the linkage assembly 200 are represented as dashed lines to indicate that the connections may vary the type of attachment and the attachment mechanisms used. Details of this will be described in other sections. The device 10 may include other elements and/or components that may be necessary for the device 10 to perform its desired functionalities as described in this specification.

Figure 2:
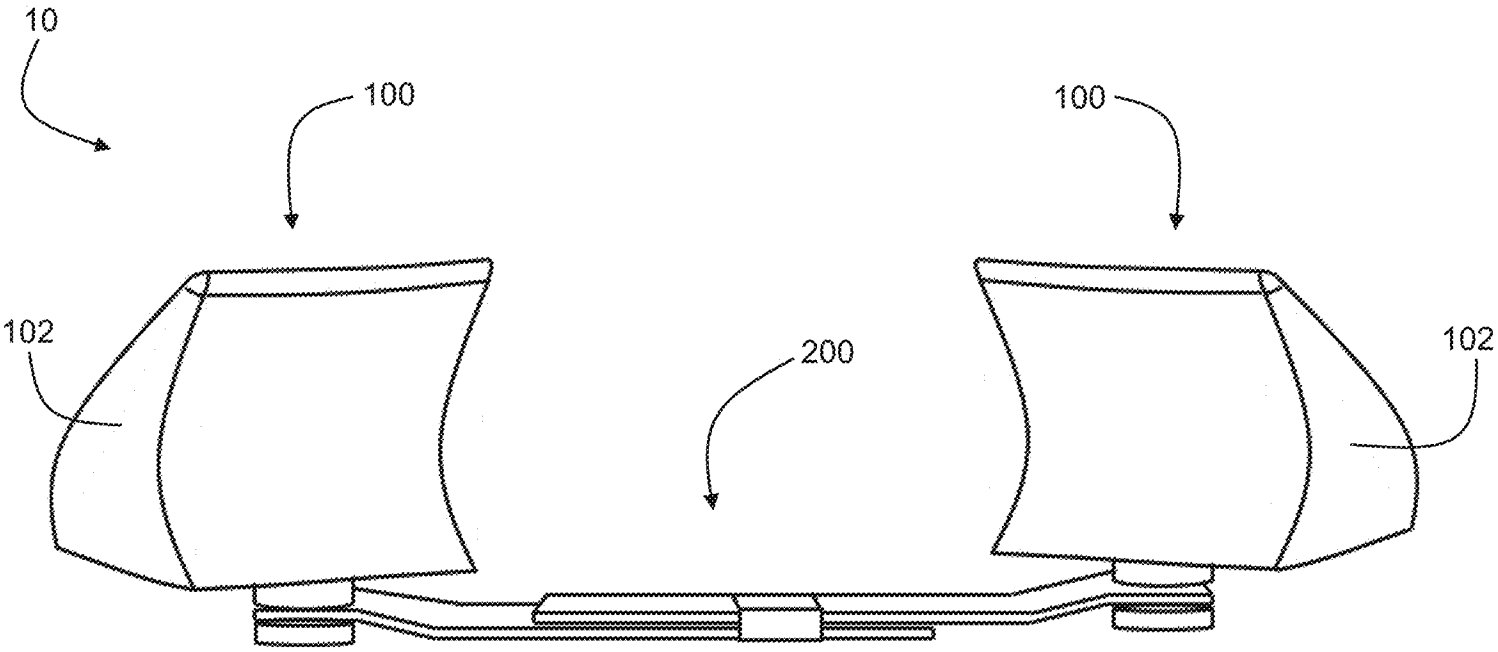

In some embodiments as shown in FIG. 2, the blade assembly 100 includes one, two or more blades 102. In one embodiment, the blade assembly 100 includes two blades 102 (e.g., a left blade 102-L and a right blade 102-R).

For the purposes of this specification, in some instances within this specification, a blade 102 may be described singularly with the understanding that descriptions of a single blade 102 also may apply to additional blades 102 of the blade assembly 100 as described in other sections.

Figure 3:
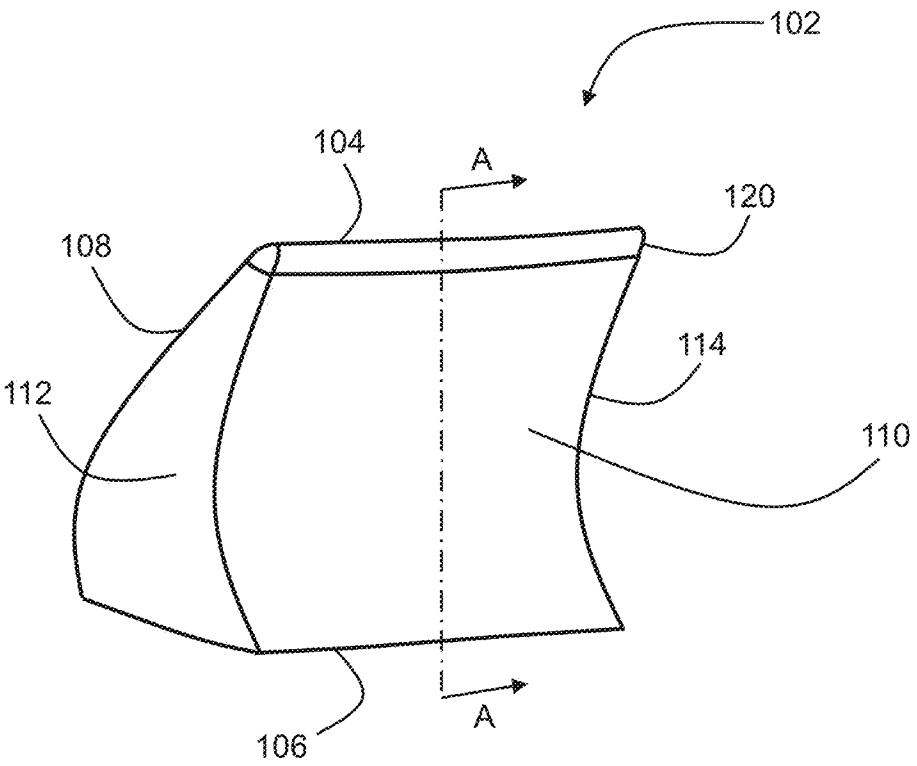
FIG. 3 shows aspects of a massage device blade according to exemplary embodiments hereof.

In some embodiments as shown in FIG. 3, the blade 102 includes a top 104, a bottom 106, a back 108, a front 110, a left side 112 and a right side 114. In general, several surfaces of the blade 102 may be adapted to contact the bodily tissues and nerves to be massaged. For example, the top 104 and the back 108 may be adapted for these purposes as will be described in other sections.

Figure 4:
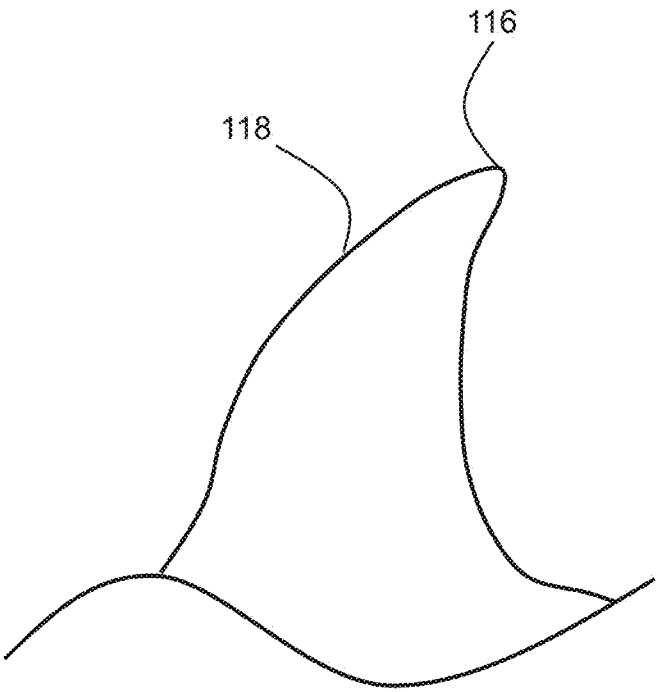
FIGS. 4-5 show aspects of a massage device blade according to exemplary embodiments hereof.

In one exemplary embodiment hereof, the cross-sectional shape of the blade 102 looking in the direction of cut lines A-A resembles a "shark fin" or "killer whale fin" shape as shown in FIG. 4. In this embodiment, the top 104 includes a top ridge 116, the back 108 includes a sloping convex back surface 118 and the front 110 includes a concave curvature. The upper tip of the top ridge 116 may be generally rounded, sharp, squared (with a front and back edge), other shapes and any combination thereof. As will be described in other sections, the top ridge 116 may be used to apply cross-fiber pressure to the psoas muscles and/or the ventral rami (including the anterior rami) of the lumbar plexus L1-L4, femoral nerves, and saphenous nerves of the patient, and the convex back surface 118 may be used to apply deep tissue pressure to the iliacus muscle and/or lateral femoral cutaneous nerves.

In some embodiments, the blade 102 comprises any suitable material(s) such as, without limitation, natural and/or synthetic rubber, plastic, wood, cork, metal, ceramic, stone, other materials and any combination thereof. The blade 102 may be solid or hollow, and/or may include both solid portions and hollow portions.

In some embodiments, the top ridge 116 may comprise the same or different material and/or material characteristics as the body of the blade 102. For example, if the body of the blade 102 comprises a hard solid material, the top ridge 116 may include a top layer 120 (best seen in FIG. 3) that may comprise a softer layer such as silicon, rubber or other type of polymer. In another example, if the body of the blade 102 comprises a softer material, the top ridge 116 may include a top layer 120 that may comprise a harder layer such as plastic, rubber or other type of polymer. In some embodiments the layer 120 may range from 1.0 mm thick to 1.0 inch thick or more as desired.

In some embodiments, the top ridge 116 may be generally smooth while in other embodiments the top ridge 116 may include textures, bumps, notches, other surface characteristics and any combination thereof.

Figure 5:
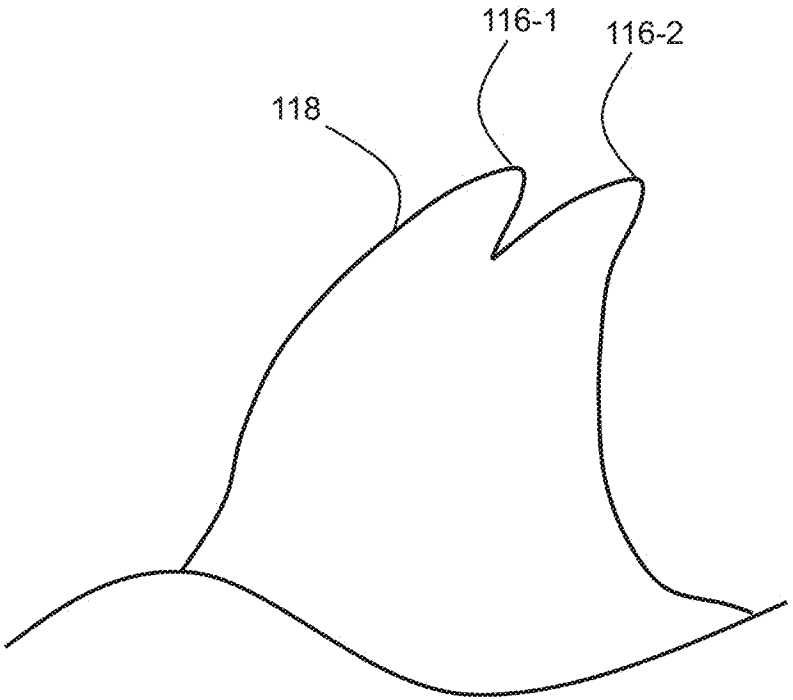

In one exemplary embodiment hereof, the top 104 may include two or more top ridges 116-1, 116-2, . . . **116-*n* (collectively and individually 116). An example blade 102 with two top ridges 116-1, 116-2 is shown in FIG. 5. In some embodiments, the top ridges 116 may be generally parallel with respect to one another (from the left 112 to the right 114), while in other embodiments the top ridges 116 may be at offset angles with respect to one another. In some embodiments, the top of the ridges 116 may be even with respect to one another and in other embodiments one or more of the top ridges 116 may extend higher or lower than other top ridges 116. In some embodiments, the widths of the top ridges 116 may be the same or similar and in other embodiments the widths of the top ridges 116 may differ with respect to one another (e.g., some top ridges 116** may be thicker or thinner than others).

In some embodiments, the top ridge(s) 116 may be generally linear from the left 112 to the right 114. In other embodiments, the top ridge(s) 116 may include curvatures. For example, in one embodiment, a top ridge 116 may be upwardly bowed from the left 112 to the right 114. In another example, a top ridge 116 may include steps, saw-tooth structures or other structural characteristics from the left 112 to the right 114.

In some embodiments, the height of the blade 102 may measure 1.0-4.0 inches and preferably 2.0-3.0 inches. In some embodiments, the length (along the front 110 or back 108 from the left 112 to the right 114) may measure 1.0-6.0 inches and preferably 2.0-4.0 inches. In some embodiments, the width (along the left 112 or right 114 from the front 110 to the back 108) may measure 1.0-4.0 inches and preferably 1.0-2.0 inches. It is understood by a person of ordinary skill in the art that the dimensions may include other ranges and/or values as required by the tool 10 and by the body type and/or size of the patient, and that the scope of the tool 10 is not limited in any way by the dimensions of the blade(s) 102.

Figure 6:
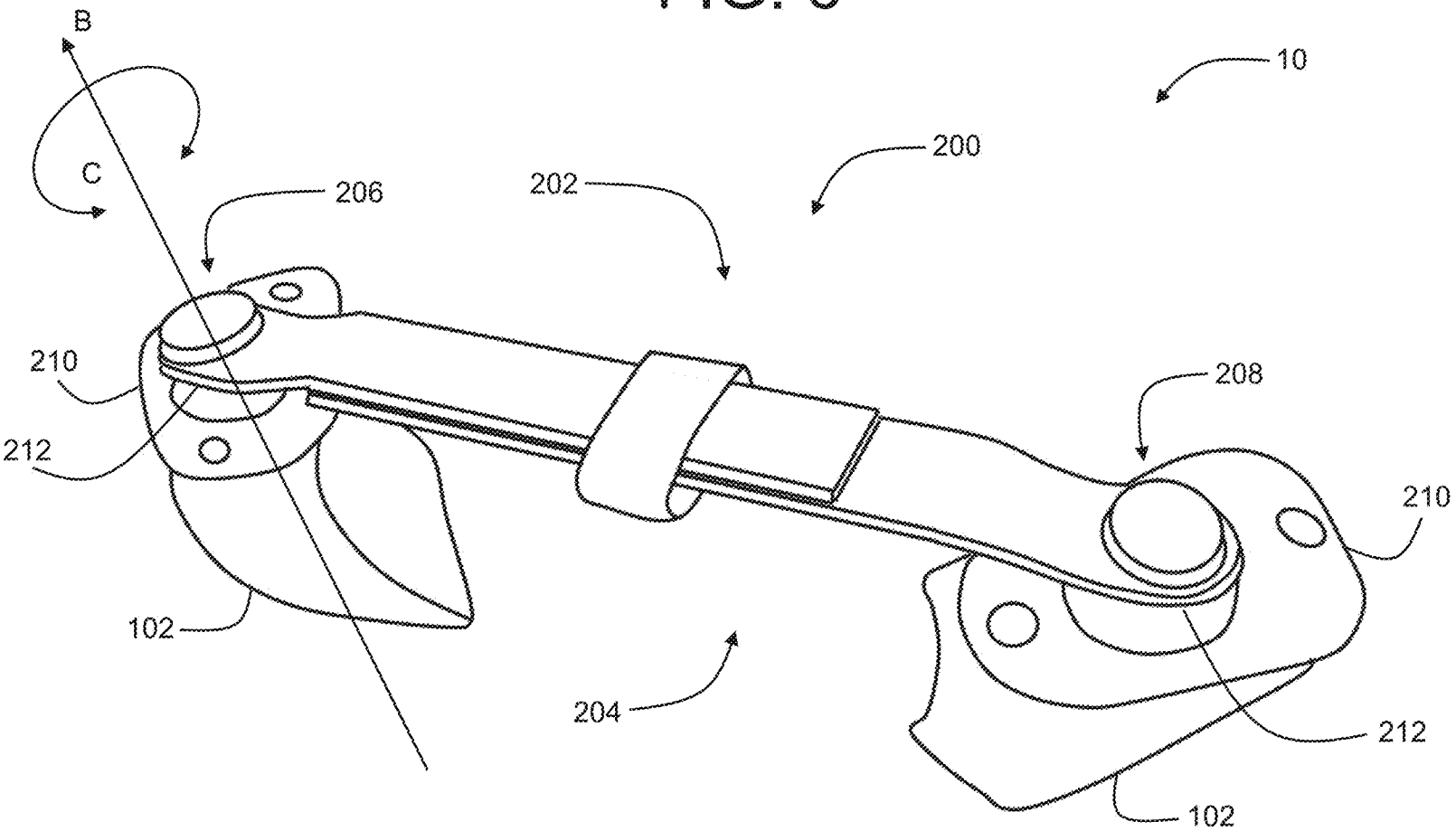
FIG. 6-9 shows aspects of a massage device according to exemplary embodiments hereof.

In one exemplary embodiment hereof as shown in FIG. 6, the link assembly 200 comprises a central support structure 202 that extends between a first blade 102 (e.g., a left blade 102-L) and a second blade 102 (e.g., a right blade 102-R) thereby physically linking the first and second blades 102 together. In some embodiments, the left blade 102-L and the right blade 102-R are configured with the link assembly 200 so that the fronts 110 of each blade 102-L, 102-R may generally face towards one another (although not necessarily straight on and/or directly as shown).

In some embodiments, the support structure 202 may include a bar, rail, plate or other sufficient structure that extends between the blades 102-L, 102-R thereby connecting the blades 102-L, 102-R together. In some embodiments, the support structure 202 includes a body 204 with a left end 206 and a right end 208, the left and right ends 206, 208 each adapted to attach to a blade 102.

In one embodiment, the link assembly 200 includes a first blade base 210 (e.g., a left blade base 210-L) and a second blade base 210 (e.g., a right blade base 210-R), each blade base 210 adapted to attach to a respective left or right side 106, 108 of the support structure 202. Each blade base 210 also is adapted to attach to an associated blade 102, thereby attaching the associated blade 102 to the left or right side 106, 108 of the structure 202, respectively. In one implementation, the left blade 102-L is attached to the left blade base 210-L and the right blade 102-R is attached to the right base 210-R. In some embodiments the first and second blade bases 210 include plates or other types of support structures that may generally receive and attach to the bottom 106 of each respective blade 102. An example of this is shown in FIG. 6 with the device 10 upside-down and resting on its blades 102.

The size and shape of the blade bases 210 preferably generally corresponds to the size and shape of the bottom 106 of each corresponding blade 102, but other sized and shaped bases 210 may also be used. Each blade 102 may be attached to a corresponding blade base 210 using adhesive, screws, other types of attachment mechanisms and any combination thereof. In other embodiments, the left and right sides 206, 208 of the support structure 202 are attached directly to the bottoms 106 of each respective blade 102 using the same or similar attachment methods.

In one exemplary embodiment hereof, each blade base 210 is attached to its respective left or right side 206, 208 using a rotatable mount 212. In this way, each blade base 210 (and its associated blade 102) may rotate about its perpendicular axis (in the direction of arrow C about the axis B in FIG. 6). In some embodiments, the rotatable mount 212 may comprise a bolt that passes through an opening in a corresponding end 206, 208 inside which the bolt may rotate. In other embodiments, the rotatable mount 212 may include a bearing that is attached to a corresponding end 206, 208. In any event, the rotatable mount 212 may comprise any sufficiently rotatable-type mount that may allow an attached blade 102 and its associated base 210 to rotate about an axis perpendicular with respect to its associated plate 210.

Figure 7:
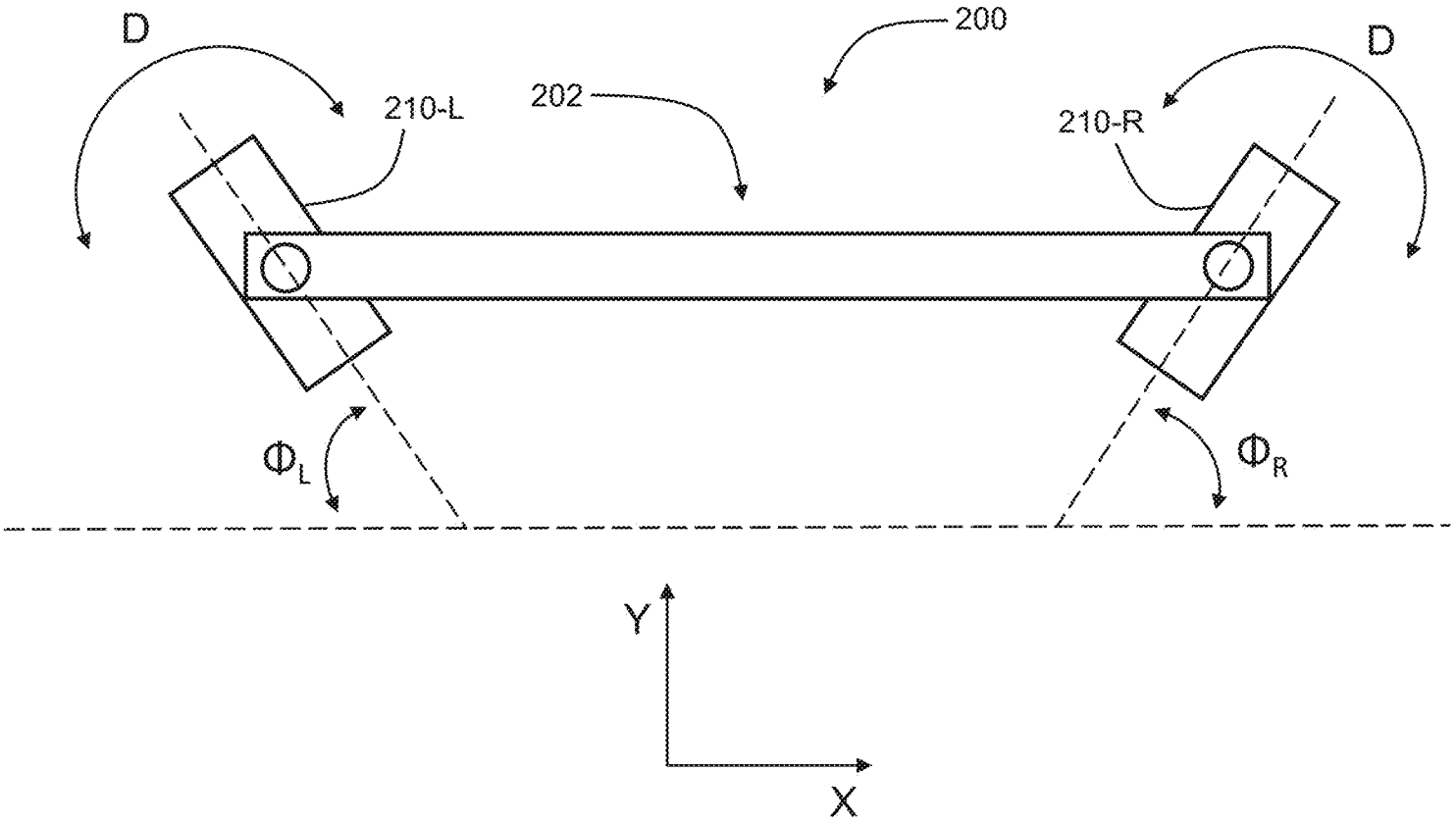

In some embodiments as shown in FIG. 7, the left blade base 210-L may be set to a particular rotational angle $\Phi_L$ and/or the right blade base 210-R may be set to a particular rotational angle $\Phi_R$, both with respect to the longitudinal axis of the support structure 202 (e.g., the X-axis as shown), and then locked in place. In one exemplary embodiment hereof, the angles $\Phi_L$ and $\Phi_R$ may be set to 40°-45°. In other embodiments, the angles $\Phi_L$ and $\Phi_R$ may be set to an angle between 20°-90°. It is understood that the left and right blade bases 210-L, 210-R and associated blades 102-L, 102-R may be set to any rotational blade angle as required for the proper use of the tool 10.

In one example, the rotatable mount 212 comprises a bolt and nut combination, and the bolt may be loosened from the nut (e.g., using a thumb screw) so that the blade base 210 may be rotated to the desired angular position. The bolt may then be tightened to lock the base 210 in place. In another example, the rotatable mount 212 may include detents and notches and/or a ratchet element that may allow for the blade base 210 to be rotated when sufficient force is applied and subsequently held in place by the detents/notches and/or ratchet element when the tool 10 is in use. It is understood that the example rotatable mount 212 architectures described above are meant for demonstration and that the rotatable mount 212 may include any mechanism that may allow for the blade base 210 to be rotated to a desired angular position and then subsequently locked in place for use of the tool 10.

In some embodiments, the blade base 210, the rotatable mount 212 and/or the support structure 202 may include alignment and/or setting marks to facilitate the angular setting of the blade base 210 to a desired angular position. For example, the blade base 210 and/or the support structure 202 may include tick marks with corresponding angular settings (e.g., 40°, 45°, 50°, etc.) to facilitate the setting of the blade base 210 to a particular angle relative to the support structure 202. The angle setting of the blades 102 during use of the tool 10 will be described in other sections.

In some embodiments, one or both blade bases 210 may be generally rotationally fixed in place (not easily rotatable) and attached to the support structure 202 using a fixed mount. In this case, the one or fixed blade base(s) 210 and/or associated blade(s) 102 may be preset to a particular fixed angle or orientation with respect to the link assembly 200 (e.g., at 40°, 45°, 50°, etc.).

Figure 8:
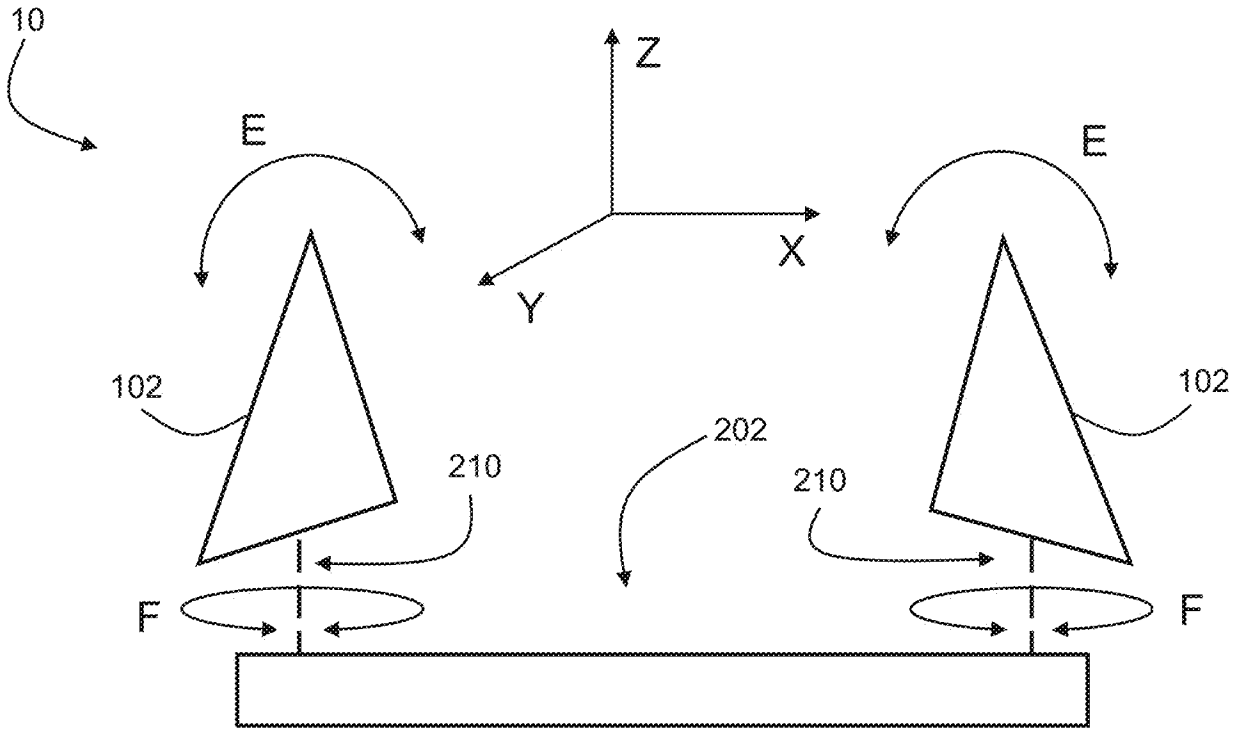

In one exemplary embodiment hereof as shown in FIG. 8, the rotatable mount 212 includes a ball joint or similar type of rotational mechanism that allows free rotation of the blades 102 and/or the blade bases 210 in two planes at the same time (e.g., as shown by arrows E and F).

Figure 9:
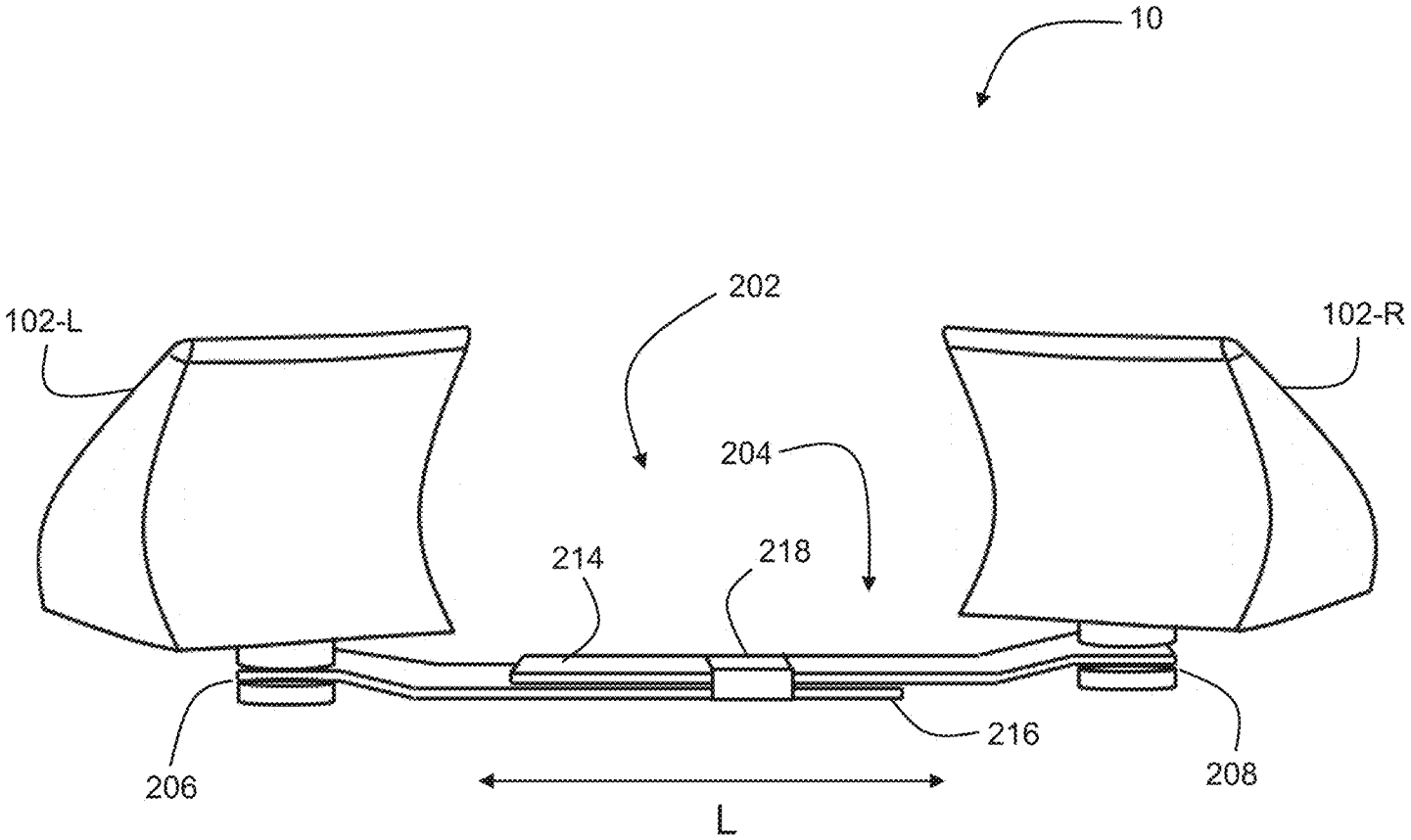

In one exemplary embodiment hereof, the length of the link assembly 200 and/or the support structure 202 is adjustable as shown in FIG. 9 and depicted by arrow L. In this way, the length of the link assembly 200 and/or the support structure 202 defines the separation distance between the two blades 102-L, 102-R, and the separation distance may be adjusted depending on the desired application of the tool 10 (as will be described in other sections). In one embodiment, the support structure 202 comprises a first section 214 and a second section 216 cascaded together to form the support structure 202. A portion of the first section 214 may overlap a portion of the second section 216 and the overlapping portions may be held together using a locking mechanism 218. As shown, the length of the portions of the sections 214, 216 that overlap may determine the overall length of the combined sections 214, 216 and thereby the length of the support structure 202. The locking mechanism 218 may include a clamp, a thumb screw, a bolt and nut, other types of locking mechanisms and any combination thereof. In addition, the first 214 and/or second section 216 may include slots, channels, grooves or other elements that may facilitate the parallel alignment of the sections 214, 216 and the easy movement of the sections 214, 216 with respect to one another.

In one embodiment, the locking mechanism 218 may be loosened and the length of the overlapping portions may be increased or shortened (e.g., by sliding the sections 214, 216 in or out with respect to one another) to increase or shorten the overall length of the support structure 202. Once the length of the support structure 202 is set to a desired length, the locking mechanism 218 may be tightened to lock the sections 214, 216 together in place and fix the support structure's length.

It is understood that the method by which the length of the support structure 202 is adjusted as described above is meant for demonstration and that the length of the support structure 202 may be adjusted using other methods, techniques and/or structure 202 architectures. For example, in some embodiments the support structure 202 may comprise telescopic cylinders, scissoring elements, and/or other types of expandable and/or retractable elements to facilitate the lengthening and/or the shortening of the support structure. In another example, in some embodiments the link assembly 200 (and/or the support structure 202) may include a plurality of openings on each end 206, 208 for attaching the blades 102 with the plurality of openings spaced apart by different distances. In any event, it is understood that the support structure 202 may comprise any design and/or any adequate elements that may allow for the distance between the first and second blades 102 to be adjusted as required by the use of the tool 10.

In some embodiments, the first section 214 and/or the second section 216 may include alignment and/or setting marks to facilitate the setting of the support structure 202 to a desired length. For example, the first section 214 and/or the second section 216 may include tick marks with corresponding length settings (e.g., 5", 6", 7", 8", 9", 10", 11", 12", 13", 14", etc.) to facilitate the setting of the support structure's length to a particular length depending on the patient's body size. This will be described in detail in other sections.

In some embodiments, the overall length of the support structure 202 may be fixed to a predetermined length (e.g., 5", 6", 7", 8", 9", 10", etc.) and may not be adjustable.

Figure 10:
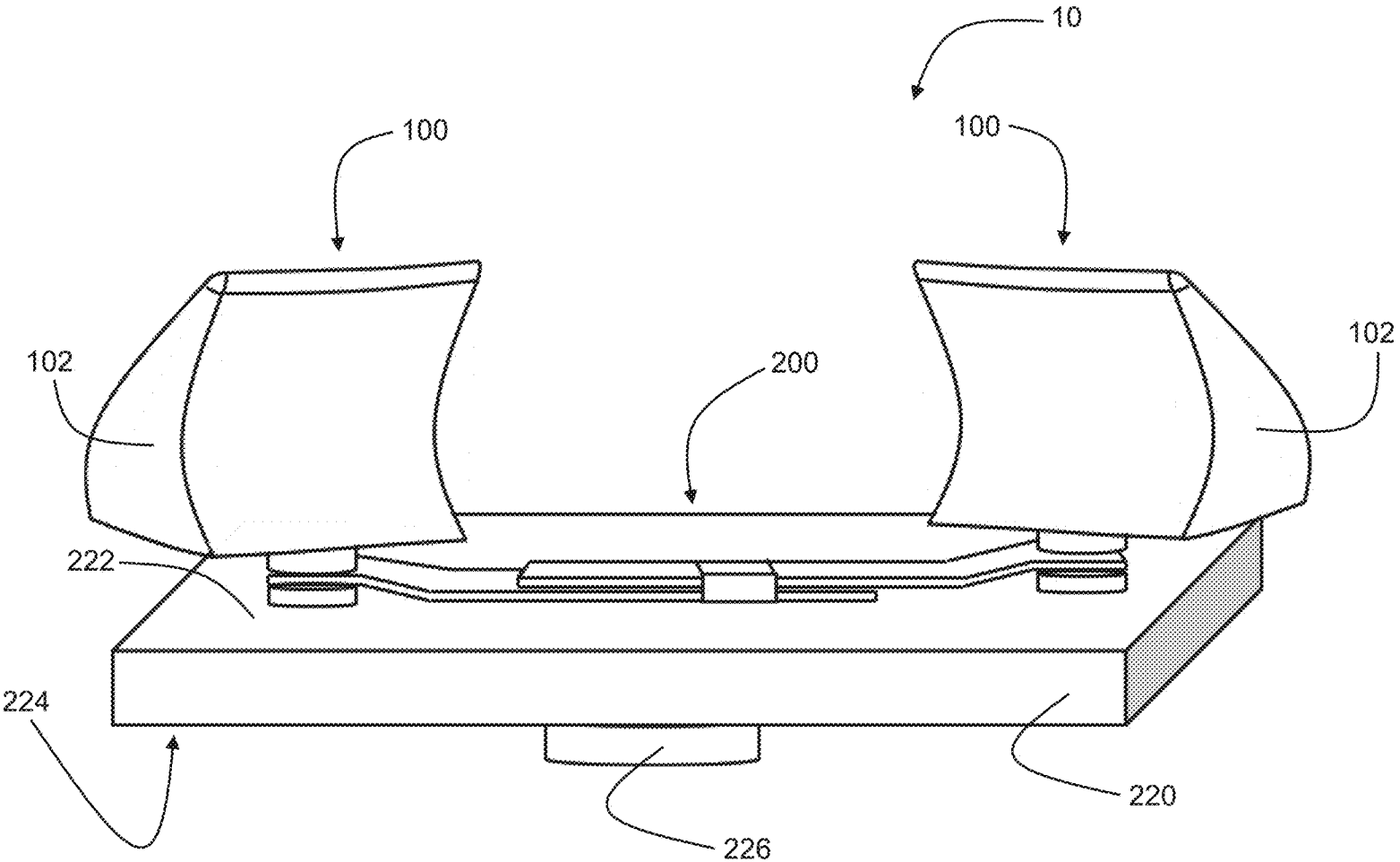
FIGS. 10-11 show aspects of a massage device support according to exemplary embodiments hereof.

In one embodiment, the tool 10 (e.g., the link assembly 200) includes a base 220 adapted to generally support the tool 10 when the tool 10 is in use. As shown in FIG. 10, the base 220 may include a top 222 (e.g., a top platform) with a footprint and attachment mechanisms that may receive and support the tool 10, and a bottom 224 with a sufficient footprint to provide lateral support to the tool 10 and to the user of the tool 10 during use. In some embodiments, the base 220 may include attachment mechanisms on the top 222 such as one or more recesses to receive a lower portion of the tool 10 (e.g., the lower portion of the support structure 202 and/or of the mounts 212), latches or clamps to secure the link assembly 200 to the base 220, other types of attachment mechanisms and any combination thereof.

In some embodiments, the base 220 may include a rotatable mount 226 (e.g., configured with its bottom 224) that may enable the base 220 to rotate and/or swivel/rock back and forth laterally to facilitate the massage action of the blades. In some embodiments, the base 220 may be independent from the support structure 202 and may be configured with the support structure 202 for use. In other embodiments, the base 220 may be integrated into the link assembly 200 (e.g., integrated with the support structure 202) and be provided as a single unit. In other embodiments, the base 220 may be used with an individual blade 102 to provide support to the blade 102.

Figure 11:
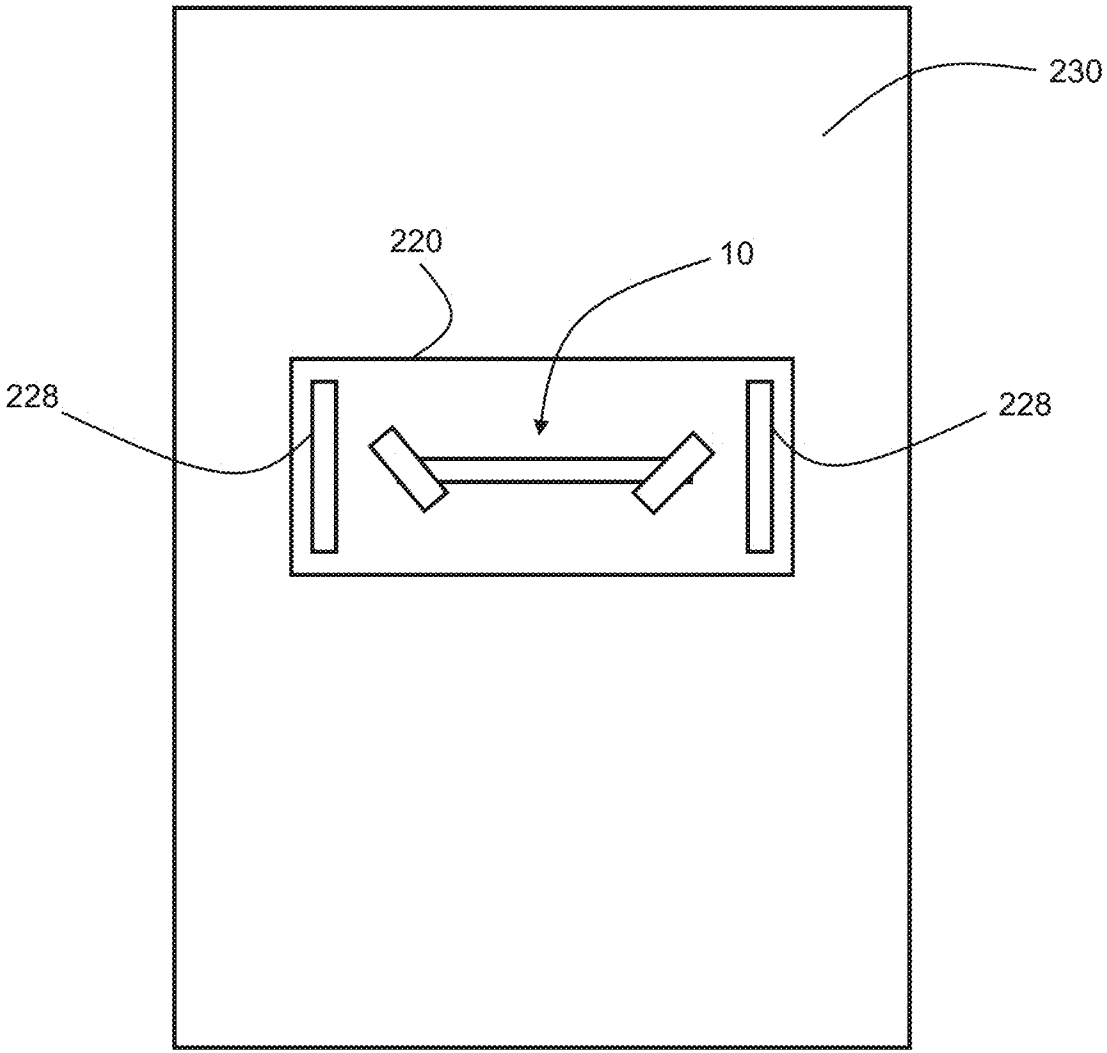

In one exemplary embodiment hereof as shown in FIG. 11, the tool 10 and/or the base 220 may be mounted vertically to be used in a standing position. For example, the base 220 may be mounted to a door 230 or other vertical structure using straps, bolts, latches, other types of attachment mechanisms and any combination thereof. In some embodiments, the base 220 may include handles 228 (e.g., one left handle and one right handle) on the left and/or right sides of the base 220 that the user may grasp and use to control his/her body position with respect to the tool 10 during use. The handles 228 may include any type of adequate handle design and may extend outward from the base 220 as necessary. For example, the handles may resemble "café racer" motorbike handles or any other types of handles.

In any event, the base 220 may include padding, handles or other features to facilitate the use of the tool 10 and to provide comfort and safety to the user. While the base 220 is depicted in FIG. 10 as generally rectangular, the base 220 may be any other shape such as circular, oval shaped, square, other shapes and any combination thereof. In some embodiments, the base 220 may include two or more portions (attached, unattached and any combination thereof) that may make up the base 220.

In Use

Figure 12:
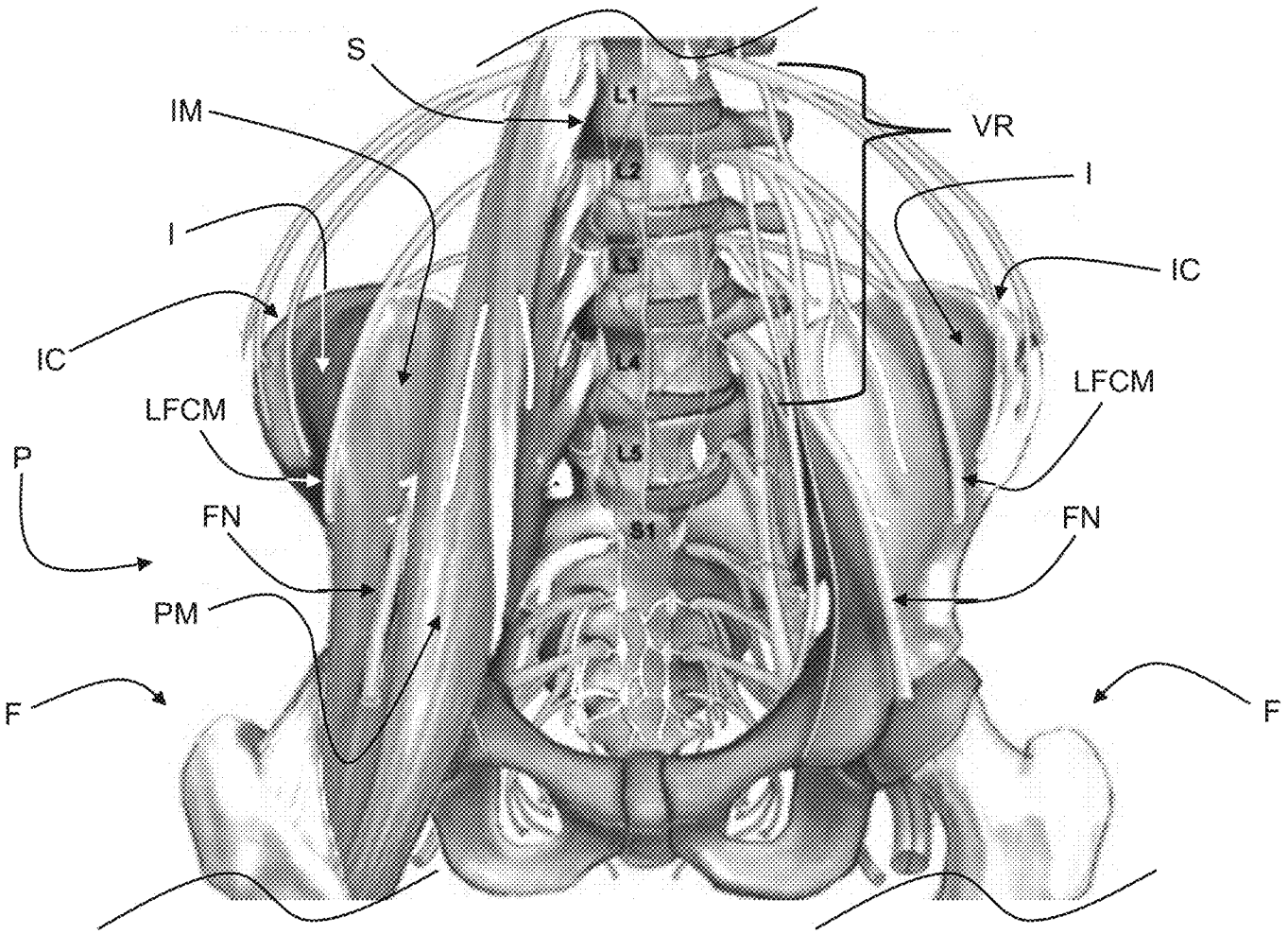
FIG. 12 shows a front pelvic schematic according to exemplary embodiments hereof.

FIG. 12 shows a schematic of the frontal pelvic region of a human body detailing the skeletal, muscular and nerve elements of the region. In general, the femur (F) (thigh bone) joins the pelvis (P) (made up of the ilium (I), the pubis (pubic bone) and the ischium) from below, and the spine (S) joins the pelvis (P) from above. The psoas muscle (PM) generally connects the lumbar vertebrae (e.g., L1, L2, L3, L4) of the spine (S) to the femur (F), and the iliacus muscle (IM) generally connects the pelvic bowl (e.g., the ilium (I)) to the femur (F). The ventral rami (VR) (including the anterior rami) emerges from the spinal cord at the lumbar vertebrae L1, L2, L3, and L4 to form the lumbar plexus.

The femoral nerve (FM) extends from dorsal divisions of the ventral rami of the second, third, and fourth lumbar nerves (L2, L3, and L4) downward and into the thigh region where it lies in a groove between the iliacus muscle (IM) and psoas major (P) muscles. From there, the femoral nerve (FM) further extends down the legs and into the feet.

The lateral femoral cutaneous nerve (LFCM) extends from dorsal divisions of the ventral rami of the second and third lumbar nerves (L2 and L3) where it emerges at the lateral edge of the psoas major (PM) muscles and then passes beneath the iliac muscle (IM) fascia. From there, the lateral femoral cutaneous nerve (LFCM) further extends down the legs into thigh, where it divides into anterior and posterior branches.

If the ventral rami (VR) and/or the femoral nerve (FM) are contracted involuntarily (e.g., due to injury), it may compact the adjacent muscles (e.g., the iliacus muscle (IM) and/or the psoas muscle (PM)) which may, in turn, compact and/or compress the bone joints that the muscles (IM), (PM) may be connected to. For example, a contraction of the femoral nerve (FM) may cause the psoas muscle (PM) to compact and/or compress the lumbar vertebrae (e.g., L1, L2, L3, L4) of the spine (S), and both the psoas muscle (PM) and the iliacus muscle (IM) to compact bone joints within the leg (e.g., hip, knee, ankle, etc.).

Figure 13:
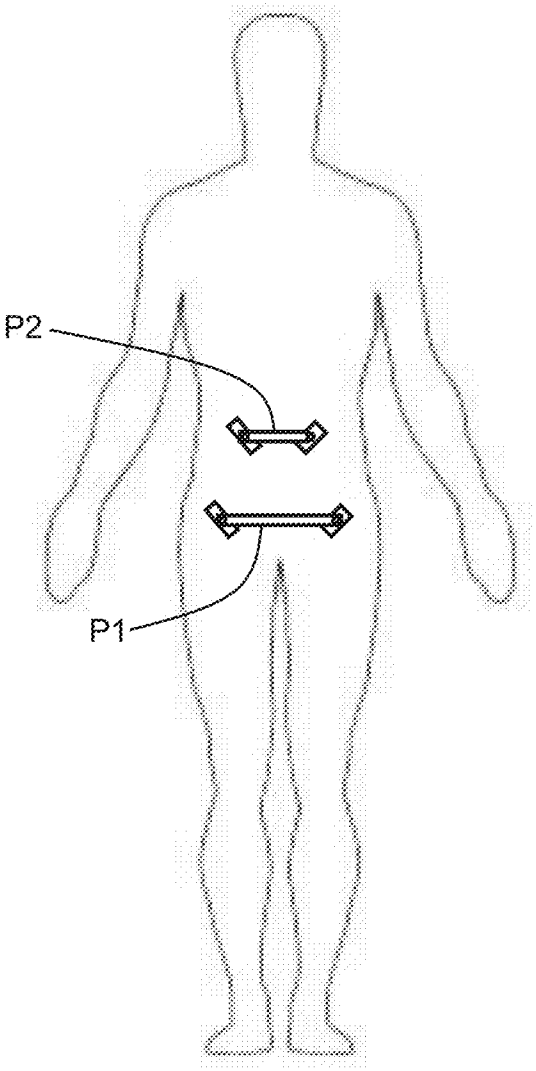

In one exemplary embodiment hereof, the tool 10 is placed on a supportive surface (e.g., the floor) with the blades 102 facing upward. The patient may then lay on the tool 10 in a prone position so that the top ridges 116 of each blade 102 may press into the patient's abdomen. Alternatively, a massage therapist may assist the patient by helping to insert the tool with the patient lying supine. As shown in FIG. 13, the distance between the left and right blades 102-L, 102-R and the angle of each blade 102-L, 102-R may be adjusted as described above so that the top ridges of each blade 102-L, 102-R are aligned with the femoral nerve (FM) in the pelvic region (i.e., aligned with the femoral nerve (FM) in the groove between the iliacus muscle (IM) and psoas major (P) muscles). This is generally shown in FIG. 13 as P1.

Note that the curvature of the blades 102 (e.g., the shark or killer whale fin shape) is contoured to follow the grades of the wings of the ilium bones on top of the iliacus muscles so that the top ridges 116 may apply cross-fiber pressure to the psoas muscles and the femoral nerves at the correct angle range (e.g., preferably 40°-45° with respect to the X-axis).

Once in this position and with the tool 10 properly aligned in place (generally at P1), the patient may gently shift his/her weight from side-to-side, causing the top ridge 116 of each blade 102-L, 102-R to penetrate the psoas muscles (PM) on both the left and right sides, respectively. In this way, pressure may be placed by the top ridge 116 onto the femoral nerve (FM), gently lengthening it away from the spinal (S) and thereby reducing its contraction and the compaction of the muscles and related joints.

In addition, this action by the patient may cause the top ridge 116 of each blade 102 to penetrate the psoas muscles (PM) providing a cross-fiber friction upon the muscles (PM). Also, this action may cause the convex back surface 118 of the blade to project a deep tissue pressure upon the iliacus muscle (IM) and the lateral femoral cutaneous nerve.

In one exemplary embodiment hereof, the tool 10 may be moved to a second abdominal site as generally shown as P2 where the action of the tool 10 may be used to treat the ventral rami (VR) (including the anterior rami) in a similar fashion. Note that it may be preferable to shorten the length L of the link assembly 200 as shown to generally follow the contour of the psoas muscles closer to vertebrae higher in the abdomen.

Figure 14:
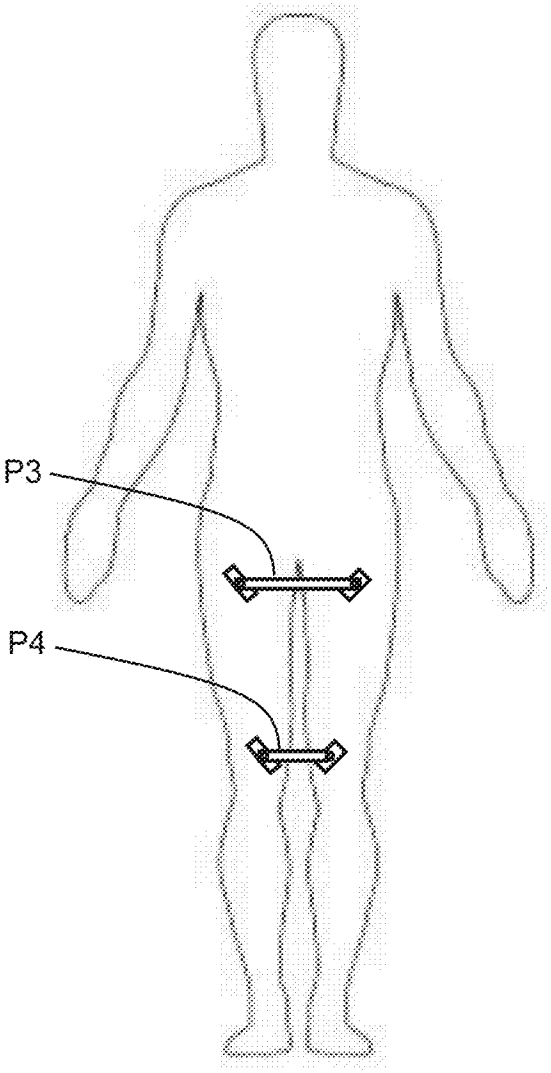
FIGS. 13-14 show aspects of the positioning of a massage device according to exemplary embodiments hereof.

In one exemplary embodiment hereof as shown in FIG. 14, with the distance between the blades 102 and the angle of the blades 102 set, the tool 10 may be placed just below the hips (as generally represented as P3) and the side-to-side motion may be repeated to treat the psoas and iliacus muscles (PM), (IM) at their attachment to the left and right femur bones (F) in the upper leg region. In this position, direct pressure may also be applied to the femoral nerves (FN) and its branches in this region to lengthen the nerves (FN) thereby relaxing the associated nerves, muscles and joints. In some implementations, the distance between the left and right blades 102-L, 102-R may not need to be adjusted between using the tool 10 in the pelvic region (as described above) and in the hip region. However, in some implementations the distance may be adjusted.

In one exemplary embodiment hereof as shown in FIG. 14, with the distance between the blades 102 and the angle of the blades 102 set, the tool 10 may be placed at any position between the hips and the knees (as generally represented as P4) to treat various muscles and/or nerves in this area. For example, the tool 10 may be positioned to treat the pectineus, adductor longus, sartorius, vastus medialis, rectus femoris, and/or other muscles and any combination thereof. In another example, the tool 10 may be positioned to treat the femoral nerve in this area, the anterior cutaneous branches of the femoral nerve, the saphenous nerve, and/or other nerves and any combination thereof.

In any of the above examples of use, the distance between the two blades 210-L, 210-R may be adjusted to different lengths (e.g., to different lengths L of the support structure 202) at any position for treatments of different or similar muscles and/or nerves. For example, the length L may be adjusted to a first length and used at the positions P1 and/or P2, and then adjusted to a second length and used at positions P1 and/or P2.

While the description above describes the use of the tool 10 for the treatment of particular muscles and/or nerves at particular sites on the human body, it is understood that the particular muscles and/or nerves at the particular sites described above are meant for demonstration and that the tool 10 may be used to treat any applicable muscle and/or nerve at any site on or in the human body. It is also understood that the scope of the tool 10 is not limited in any way by the muscle(s) and/or nerve(s) that it may be used to treat.

Those of ordinary skill in the art will appreciate and understand, upon reading this description, that embodiments hereof may provide different and/or other advantages, and that not all embodiments or implementations need have all advantages.

Where a process is described herein, those of ordinary skill in the art will appreciate that the process may operate without any user intervention. In another embodiment, the process includes some human intervention (e.g., a step is performed by or with the assistance of a human such as a massage therapists, physical therapists, etc.).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

I claim:

1. A massage device comprising:

a first blade including a first bottom defining a first vertical axis perpendicular to the first bottom, a first back surface extending from the first bottom, a first front surface extending from the first bottom, and a first top ridge at an intersection of the first back surface and the first front surface, the first back surface including a first convex surface and the first front surface including a first concave surface, wherein the first convex surface includes a slope that varies in the direction of the first vertical axis;

a second blade including a second bottom defining a second vertical axis perpendicular to the second bottom, a second back surface extending from the second bottom, a second front surface extending from the second bottom, and a second top ridge at an intersection of the second back surface and the second front surface, the second back surface including a second convex surface and the second front surface including a second concave surface, wherein the second convex surface includes a slope that varies in the direction of the second vertical axis;

a support structure configured with the first bottom and the second bottom, and adaptable to support the first and second blades at a first separation distance; and a first rotating member configured with the first blade and the support structure and a second rotating member configured with the second blade and the support structure;

wherein the support structure is adaptable to change the first separation distance to a second separation distance distinct from the first separation distance;

wherein the first top ridge and/or the second top ridge is adaptable for use in performing a body massage treatment;

wherein an axis of rotation of the first rotating member enables the first blade to rotate about an axis perpendicular to the first top ridge.

2. The massage device of claim 1 wherein the axis of rotation of the second rotating member enables the second blade to rotate about an axis perpendicular to the second top ridge.

3. The massage device of claim 1 further comprising a base adaptable to support the support structure.

4. The massage device of claim 3 further comprising at least one of a left handle and a right handle configured with the base.

5. The massage device of claim 1 wherein the first back surface intersects the first bottom at a first furthermost back point in a first horizontal plane, the first front surface intersects the first bottom at a first furthermost front point in the first horizontal plane, and the first top ridge includes an uppermost first top ridge apex, wherein the uppermost first top ridge apex is closer to the first furthermost front point than to the first furthermost back point.

6. A massage device comprising:

a first blade including a first bottom, a first back surface extending from the first bottom, a first front surface extending from the first bottom, and a first top ridge at an intersection of the first back surface and the first front surface, the first back surface including a first convex surface and the first front surface including a first concave surface;

a second blade including a second bottom, a second back surface extending from the second bottom, a second front surface extending from the second bottom, and a second top ridge at an intersection of the second back surface and the second front surface, the second back surface including a second convex surface and the second front surface including a second concave surface;

a support structure comprising a first section configured with the first bottom and a second section configured with the second bottom, the first and second sections in an overlapping arrangement, the support structure adapted to vary an amount of overlap between the first and second sections to vary a first separation distance between the first and second blades; and a first rotating member configured with the first blade and the support structure and a second rotating member configured with the second blade and the support structure;

wherein the first ridge and/or the second ridge is adaptable for use in performing a body massage treatment;

wherein an axis of rotation of the first rotating member enables the first blade to rotate about an axis perpendicular to the first top ridge.

7. The massage device of claim 6 wherein the first back surface intersects the first bottom at a first furthermost back point in a first horizontal plane, the first front surface intersects the first bottom at a first furthermost front point in the first horizontal plane, and the first top ridge includes an uppermost first top ridge apex, wherein the uppermost first top ridge apex is closer to the second first furthermost front point than to the first furthermost back point.

8. A massage device comprising:

a first blade including a first bottom, a first back surface extending from the first bottom, a first front surface extending from the first bottom, and a first top ridge at an intersection of the first back surface and the first front surface, wherein the first back surface intersects the first bottom at a first furthermost back point in a first horizontal plane, the first front surface intersects the first bottom at a first furthermost front point in the first horizontal plane, and the first top ridge includes an uppermost first top ridge apex, wherein the positioning of the uppermost first top ridge apex is closer to the first furthermost front point than to the first furthermost back point;

a second blade including a second bottom, a second back surface extending from the second bottom, a second front surface extending from the second bottom, and a second top ridge at an intersection of the second back surface and the second front surface, wherein the second back surface intersects the second bottom at a second furthermost back point in a second horizontal plane, the second front surface intersects the second bottom at a second furthermost front point in the second horizontal plane, and the second top ridge includes an uppermost second top ridge apex, wherein the uppermost second top ridge apex is closer to the second furthermost front point than to the first second furthermost back point in the horizontal plane;

a support structure configured with the first bottom and the second bottom, and adaptable to support the first and second blades at a first separation distance; and a first rotating member configured with the first blade and the support structure and a second rotating member configured with the second blade and the support structure;

wherein the first top ridge and/or the second top ridge is adaptable for use in performing a body massage treatment;

wherein an axis of rotation of the first rotating member enables the first blade to rotate about an axis perpendicular to the first top ridge.

9. The massage device of claim 8 wherein the support structure is adaptable to change the first separation distance to a second separation distance distinct from the first separation distance.

10. The massage device of claim 5 wherein the second back surface intersects the second bottom at a second furthermost back point in a second horizontal plane, the second front surface intersects the second bottom at a second furthermost front point in the second horizontal plane, and the second top ridge includes an uppermost second top ridge apex, wherein the uppermost second top ridge apex is closer to the second furthermost front point than to the second furthermost back point.

11. The massage device of claim 1 wherein the support structure comprises a first section configured with the first bottom and a second section configured with the second bottom, the first and second sections in an overlapping arrangement, the support structure adapted to vary an amount of overlap between the first and second sections to change the first separation distance to the second separation distance.

12. The massage device of claim 9 wherein the support structure comprises a first section configured with the first bottom and a second section configured with the second bottom, the first and second sections in an overlapping arrangement, the support structure adapted to vary an amount of overlap between the first and second sections to change the first separation distance to the second separation distance.

13. The massage device of claim 8 wherein the first bottom defines a first vertical axis perpendicular to the first bottom, the first back surface including a first convex surface and the first front surface including a first concave surface, wherein the first convex surface includes a slope that varies in the direction of the first vertical axis; and wherein the second bottom defines a second vertical axis perpendicular to the second bottom, the second back surface including a second convex surface and the second front surface including a second concave surface, wherein the second convex surface includes a slope that varies in the direction of the second vertical axis.

14. The massage device of claim 1 further comprising a rocking mount configured with the support structure and adapted to support the support structure during a back and forth rocking motion.

15. The massage device of claim 3 further comprising a rocking mount configured with the base and adapted to support the base during a back and forth rocking motion.

16. The massage device of claim 6 further comprising a rocking mount configured with the support structure and adapted to support the support structure during a back and forth rocking motion.

* * * * *